US012023719B2

(12) United States Patent
Hisada

(10) Patent No.: US 12,023,719 B2
(45) Date of Patent: Jul. 2, 2024

(54) ROLLING DIE AND METHOD FOR MANUFACTURING SAME

(71) Applicant: OSG CORPORATION, Toyokawa (JP)

(72) Inventor: Teruya Hisada, Toyokawa (JP)

(73) Assignee: OSG CORPORATION, Toyokawa (JP)

( * ) Notice: Subject to any disclaimer, the term of this patent is extended or adjusted under 35 U.S.C. 154(b) by 0 days.

(21) Appl. No.: 17/911,966

(22) PCT Filed: Mar. 26, 2020

(86) PCT No.: PCT/JP2020/013575

§ 371 (c)(1),
(2) Date: Sep. 15, 2022

(87) PCT Pub. No.: WO2021/192131

PCT Pub. Date: Sep. 30, 2021

(65) Prior Publication Data

US 2023/0302513 A1 Sep. 28, 2023

(51) Int. Cl.

| | |
|---|---|
| ***B21B 27/02*** | (2006.01) |
| ***C23C 8/26*** | (2006.01) |
| ***C23C 22/62*** | (2006.01) |
| ***C23C 28/04*** | (2006.01) |

(Continued)

(52) U.S. Cl.
CPC ..... *B21B 27/02* (2013.01); *C23C 28/044* (2013.01); *C23C 8/26* (2013.01); *C23C 22/62* (2013.01)

(58) Field of Classification Search
CPC ..... B21B 27/02; C23C 28/044; C23C 8/26; C23C 22/62
See application file for complete search history.

(56) References Cited

U.S. PATENT DOCUMENTS 4,839,949 A * 6/1989 Sobue ..... C04B 35/597 492/53
7,357,975 B2 * 4/2008 Vetter ..... C23C 28/044 204/192.15

(Continued)

FOREIGN PATENT DOCUMENTS

JP 2008-138235 A 6/2008
JP 2010-005654 A 1/2010

(Continued)

OTHER PUBLICATIONS

English Translation of JP 2011036949 A (Year: 2011).*

(Continued)

*Primary Examiner* — Jason L Vaughan
(74) *Attorney, Agent, or Firm* — WHDA, LLP

(57) ABSTRACT

Provided is a rolling die that increases the durability of a nitrided molded surface. The rolling die (1) includes a tool base material that is made of steel and has a molded surface (2) on which a plurality of working teeth (10) is formed. The tool base material includes a nitride layer (15) in which nitrogen is diffused. The nitride layer (15) is disposed to reach a position that is 20 to 70 μm in depth from the molded surface (2). The molded surface (2) has a surface hardness of at least 1100 HV. The rate of depth change from the depth (D1) of the nitride layer (15) at crests (11) of the working teeth (10) to the depth (D2) of the nitride layer (15) at roots (13) of the working teeth (10) is not higher than 30%.

4 Claims, 2 Drawing Sheets

(56) References Cited

U.S. PATENT DOCUMENTS

| | | | | |
|---|---|---|---|---|
| 7,368,182 | B2 * | 5/2008 | Kubota | C23C 30/005 51/307 |
| 8,894,778 | B2 * | 11/2014 | Morita | C22C 38/02 148/210 |
| 2004/0116223 | A1 * | 6/2004 | Harakawa | F01L 1/3442 474/152 |
| 2009/0320551 | A1 | 12/2009 | Ogura | |
| 2014/0023740 | A1 * | 1/2014 | Kashi | B21D 37/01 425/89 |
| 2015/0211213 | A1 * | 7/2015 | George | E21C 35/18 148/334 |
| 2016/0208875 | A1 * | 7/2016 | Yoshikawa | C22C 38/12 |

FOREIGN PATENT DOCUMENTS

| | | | |
|---|---|---|---|
| JP | 2011-36949 | A | 2/2011 |
| JP | 2014-221478 | A | 11/2014 |

OTHER PUBLICATIONS

Notification of Transmittal of Translation of the International Preliminary Report on Patentability (Form PCT/IB/338) issued in counterpart International application No. PCT/JP2020/013575 mailed Sep. 29, 2022 with Forms Form PCT/IPEA/409. (4 pages).

International Search Report dated Jun. 16, 2020, issued in counterpart Application No. PCT/JP2020/013575. (5 pages).

Written Opinion dated Jun. 16, 2020, issued in counterpart Application No. PCT/JP2020/013575. (3 pages).

International Preliminary Report on Patentability (Form PCT/IPEA/409) issued in counterpart International Application No. PCT/IPEA/409 dated Aug. 18, 2021. (3 pages).

Extended (Supplementary)European Search Report dated May 3, 2023, issued in counterpart EP Application No. 20926385.4. (7 pages).

Office Action dated Feb. 14, 2024, issued in counterpart EP application No. 20 926 385.4. (8 pages).

Third party submission dated Jan. 18, 2024, issued in counterpart EP application No. 20926385.4, with English translation. (25 pages).

H.J. Spies, "Nitrieren und Nitrocarburieren", GefugeEigenschaftenkontrolliertes Nitrieren, J. Heat Treatm. Mat., May 2013, vol. 68, No. 2, pp. 86-96, cited in EP Office Action dated Jan. 18, 2024. (11 pages).

Anonymous Ed—Dr-Ing Dieter Liedtke:"Merkblatt 447—Warmebehandlung von Stahl—Nitrieren und Nitrocarburieren", Internet Citation, Jan. 2005, pp. 1-44, XP002698715, cited in EP dated EP Office Action dated Feb. 14, 2024. (44 pages).

* cited by examiner

[Fig. 1]
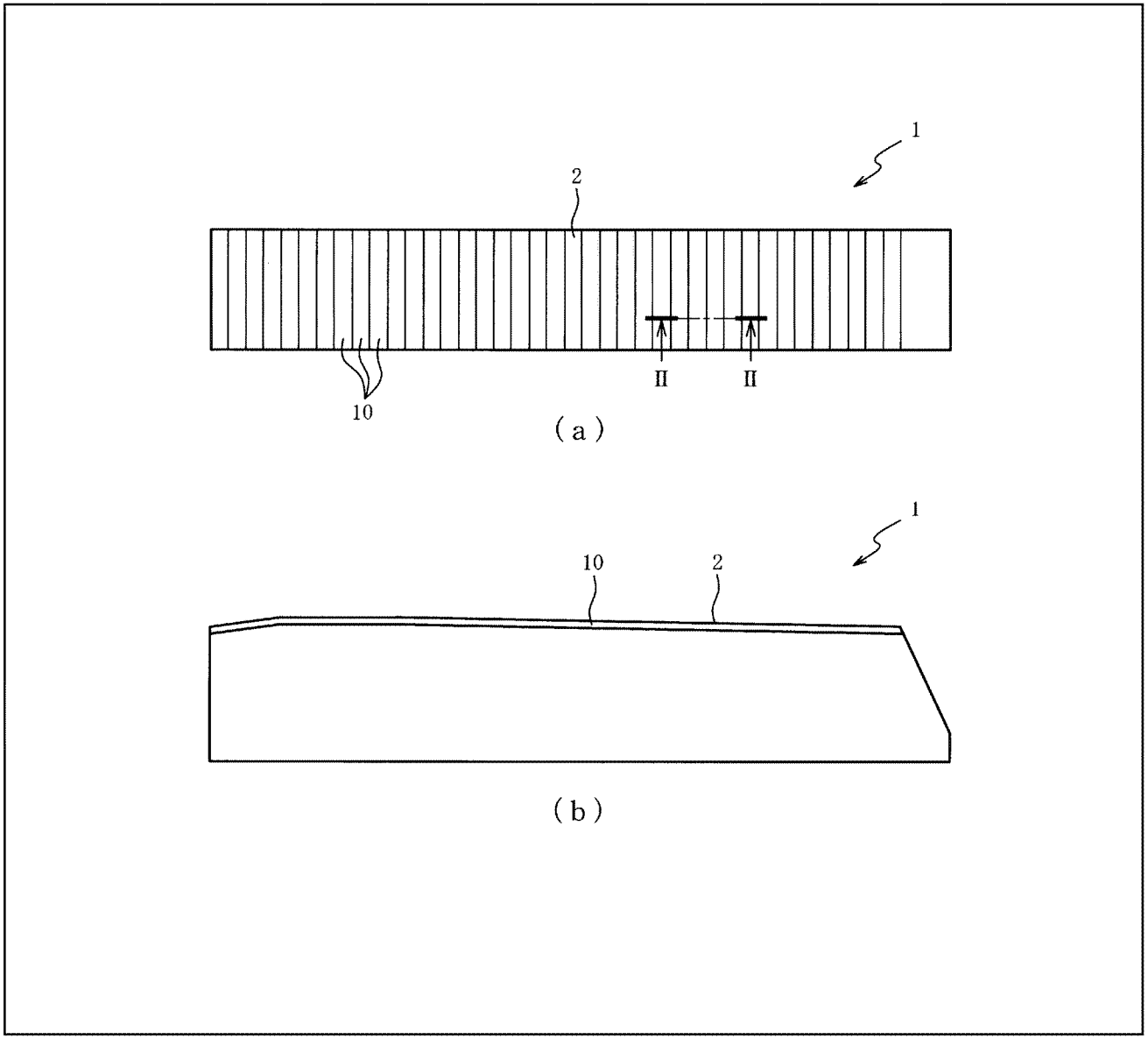

[Fig. 2]
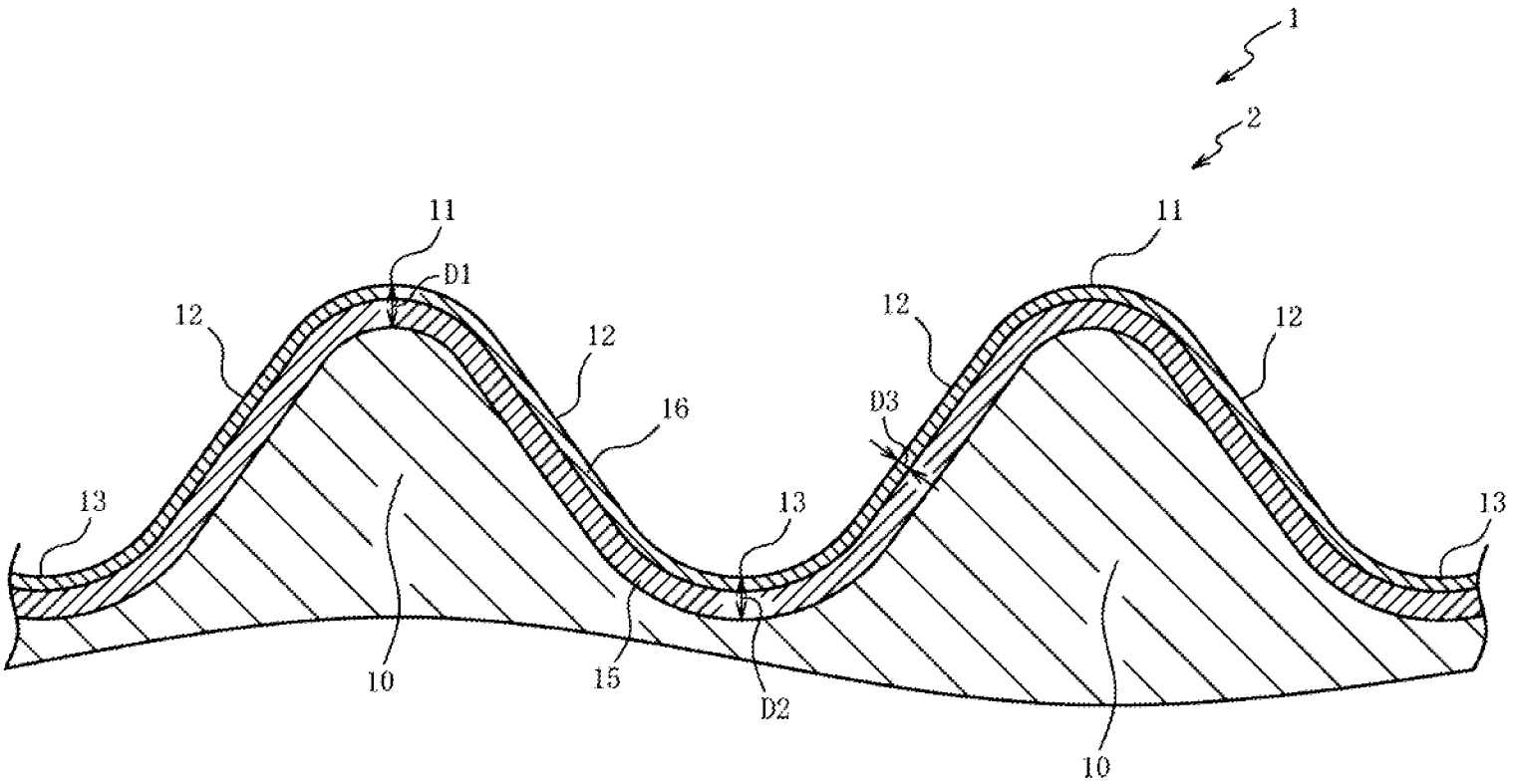

ROLLING DIE AND METHOD FOR MANUFACTURING SAME

TECHNICAL FIELD

The present invention relates to a rolling die and a method for manufacturing the rolling die. More particularly, the present invention relates to a rolling die and a method for manufacturing the rolling die that are capable of increasing the durability of a nitrided molded surface.

BACKGROUND ART

A rolling die plastically deforms a workpiece by pressing a molded surface, on which a plurality of working teeth is formed, against the workpiece, and thus roll-forms the workpiece into a predetermined shape based on the molded surface. It is known that the molded surface is nitrided to form a nitride layer in order to inhibit the molded surface from wearing and chipping and increase the durability of the molded surface. Patent Literature 1 describes an ion nitriding process that is used to nitride the molded surface of a rolling die.

CITATION LIST

Patent Literature

Patent Literature 1: Japanese Unexamined Patent Application Publication No. 2008-138235

SUMMARY OF INVENTION

Technical Problem

However, in a case where the molded surface on which the working teeth are formed is ion-nitrided, ions are likely to concentrate on the crests of the working teeth and unlikely to strike the roots of the working teeth. Therefore, the nitride layer at the crests of the working teeth is likely to become deep, and the nitride layer at the roots of the working teeth is likely to become shallow. As a result, the durability of the molded surface might not be sufficiently increased due to variation in the depth of the nitride layer. Under these circumstances, it is demanded that the durability of the molded surface be further increased.

The present invention has been made to meet the above demand. An object of the present invention is to provide a rolling die and a method for manufacturing the rolling die that are capable of increasing the durability of a nitrided molded surface.

Solution to Problem

In accomplishing the above object, according to an aspect of the present invention, there is provided a rolling die that has a molded surface on which a plurality of working teeth is formed, and is made of a steel tool base material. The tool base material includes a nitride layer in which nitrogen is diffused. The nitride layer is disposed to reach a position that is 20 to 70 μm in depth from the molded surface. The surface hardness of the molded surface is at least 1100 HV. The rate of depth change from the crests of the working teeth to the roots of the working teeth ((depth of nitride layer at crests−depth of nitride layer at roots)/depth of nitride layer at crests×100) is not higher than 30%.

According to another aspect of the present invention, there is provided a rolling die manufacturing method. The rolling die manufacturing method is for manufacturing a rolling die that has a molded surface on which a plurality of working teeth is formed, and is made of a steel tool base material. The rolling die manufacturing method includes a nitriding step and a shot peening step. In the nitriding step, a nitride layer is formed by performing a gas nitriding process or a radical nitriding process on the molded surface in such a manner that the surface hardness of the molded surface is at least 1100 HV and the depth of the nitride layer from the molded surface is 20 to 70 μm. In the shot peening step, compressive residual stress is imparted to the molded surface by performing a shot peening process on the molded surface that has been nitrided in the nitriding step.

Advantageous Effects of Invention

The rolling die according to a first aspect of the present invention is configured such that the nitride layer is formed on the molded surface having a surface hardness of at least 1100 HV, and that the depth of the nitride layer from the molded surface is 20 to 70 μm. This ensures that the molded surface is provided with sufficient abrasion resistance and strength. Further, the rate of nitride layer depth change from the crests of the working teeth formed on the molded surface to the roots of the working teeth is not higher than 30%. This not only provides the nitride layer at the roots with sufficient depth, but also prevents the nitride layer at the crests from being excessively deep. This ensures the internal toughness of the working teeth in the vicinity of the crests and inhibits the working teeth from chipping while providing the roots with sufficient abrasion resistance. As a result, the durability of the nitrided molded surface increases.

The rolling die according to a second aspect of the present invention provides the following advantageous effect in addition to the advantageous effects provided by the rolling die according to the first aspect of the present invention. Since the molded surface hardens due to the nitride layer having a surface hardness of not less than 1100 HV, the toughness of the molded surface might decrease. However, the toughness of the molded surface is ensured because the compressive residual stress of the molded surface is −1500 to −1000 MPa. This increases the durability of the molded surface.

The rolling die according to a third aspect of the present invention provides the following advantageous effect in addition to the advantageous effects provided by the rolling die according to the second aspect of the present invention. An oxide film mainly made of $Fe_3O_4$, which is obtained by oxidizing the tool base material, is formed on a portion of the nitride layer that is positioned 0.5 to 5 μm deep from the molded surface. This oxide film increases the welding resistance and seizure resistance of the molded surface.

The rolling die according to a fourth aspect of the present invention provides the following advantageous effect in addition to the advantageous effects provided by the rolling die according to the third aspect of the present invention. Ion oxide of the oxide film is made only of $Fe_3O_4$. Therefore, it is obvious that the oxide film is formed by an alkaline blackening process in which the tool base material is oxidized by immersing it in an alkaline aqueous solution instead of being formed by a steam oxidation process in which the tool base material is oxidized by heating it in a steam atmosphere having a temperature of approximately 500° C. In the alkaline blackening process, the tool base material is heated at a relatively low temperature of not higher than approximately 160° C. Therefore, the compressive residual stress imparted in advance to the molded surface is unlikely to be released during oxide film formation. This reduces the compressive residual stress that is to be imparted in advance to the molded surface before oxide film formation in order to maintain the compressive residual stress of the molded surface covered with the oxide film within the range from −1500 to −1000 MPa. As a result, the rolling die is manufactured with ease.

The rolling die manufacturing method according to a fifth aspect of the present invention is a method for manufacturing a rolling die that has a molded surface on which a plurality of working teeth is formed, and is made of a steel tool base material. In the nitriding step, a nitride layer is formed by performing a gas nitriding process or a radical nitriding process on the molded surface in such a manner that the surface hardness of the molded surface is at least 1100 HV and the depth of the nitride layer from the molded surface is 20 to 70 μm. Since the gas nitriding process or the radical nitriding process is performed on the molded surface on which the working teeth are formed, the rate of nitride layer depth change from the crests of the working teeth to the roots of the working teeth is reducible. This not only provides the nitride layer at the roots with sufficient depth, but also prevents the nitride layer at the crests from being excessively deep. As a result, the durability of the nitrided molded surface increases.

In the shot peening step, which succeeds the nitriding step, the compressive residual stress is imparted to the molded surface by performing the shot peening process on the molded surface. While the toughness of the molded surface decreases because the molded surface is hardened by the nitriding process, the compressive residual stress is imparted to the molded surface to ensure the toughness of the molded surface. This increases the durability of the molded surface.

The rolling die manufacturing method according to a sixth aspect of the present invention provides the following advantageous effect in addition to the advantageous effects provided by the rolling die manufacturing method according to the fifth aspect of the present invention. In an oxidation step subsequent to the shot peening step, an oxide film mainly made of $Fe_3O_4$ is formed on the molded surface by an alkaline blackening process in which the tool base material is oxidized by immersing it in an alkaline aqueous solution having a temperature of 130 to 160° C. This oxide film increases the welding resistance and seizure resistance of the molded surface. Further, the alkaline blackening process forms the oxide film at a lower temperature than in a case where the oxide film is formed by a steam oxidation process in which the rolling die is heated in a steam atmosphere having a temperature of approximately 500° C. Therefore, the compressive residual stress imparted by the shot peening process is unlikely to be released due to heating for oxide film formation. As a result, the oxide film increases the welding resistance and seizure resistance of the molded surface while the imparted compressive residual stress ensures the toughness of the molded surface. This further increases the durability of the molded surface.

The rolling die manufacturing method according to a seventh aspect of the present invention provides the following advantageous effect in addition to the advantageous effects provided by the rolling die manufacturing method according to the sixth aspect of the present invention. The shot peening step and the oxidation step are performed under conditions where the compressive residual stress of the molded surface oxidized in the oxidation step is −1500 to −1000 MPa. This ensures sufficient toughness of the molded surface, and thus further increases the durability of the molded surface.

BRIEF DESCRIPTION OF DRAWINGS

FIG. 1(*a*) is a plan view of a rolling die according to an embodiment of the present invention.

FIG. 1(*b*) is a side view of the rolling die.

FIG. 2 is a cross-sectional view of the rolling die taken along line II-II in FIG. 1(*a*).

DESCRIPTION OF EMBODIMENT

A preferred embodiment of the present invention will now be described with reference to the accompanying drawings. FIG. 1(*a*) is a plan view of a rolling die 1. FIG. 1(*b*) is a side view of the rolling die 1. FIG. 2 is a cross-sectional view of the rolling die 1 taken along line II-II in FIG. 1(*a*). In FIGS. 1(*a*) and 1(*b*), a plurality of working teeth 10 is schematically depicted for ease of understanding. Meanwhile, in FIG. 2, depths D1, D2, D3 of a nitride layer 15 and oxide film 16 are depicted in an exaggerated manner for ease of understanding.

The rolling die 1 is a tool for roll-forming a spline or a gear by plastically deforming the outer circumferential surface of a cylindrical workpiece, and is, more specifically, a rolling flat die. The rolling die 1 is made of a tool base material formed, for example, of alloy tool steel or high-speed tool steel and is substantially shaped like a rectangular parallelepiped. It is particularly preferable that the rolling die 1 be formed of a steel tool base material made, for example, of cold work die steel.

A molded surface 2 is on the upper surface (the upper side of FIG. 1(*b*)) of the rolling die 1. The plurality of working teeth 10 are successively formed in the left-right direction (the left-right direction of FIG. 1(*b*)) of the molded surface 2. The workpiece is rolled-formed into a predetermined shape based on the molded surface 2 by moving the molded surface 2 in the left-right direction while the molded surface 2, on which the working teeth 10 are formed, is pressed against the workpiece. The working teeth 10 are formed without being twisted in the left-right direction (rolling direction). That is to say, the working teeth 10 are engraved at a lead angle of approximately 90°.

As depicted in FIG. 2, the working teeth 10 are protruded upward from the rolling die 1, and are substantially shaped like a trapezoid when viewed laterally. The working teeth 10 are extended in the width direction (the up-down direction of FIG. 1(*a*)), which is orthogonal to the rolling direction and the up-down direction (the height direction of the working teeth 10).

The working teeth 10 each include an crest 11 and a pair of flanks 12. The crest 11 is an upper tip. The pair of flanks 12 are downward slopes from both sides of the rolling direction of the crest 11. A portion between the working teeth 10 is a root 13. The root 13 is connected to each of the flanks 12 of adjacent working teeth 10. The molded surface 2 is a surface portion that is formed by a plurality of successive crests 11, flanks 12, and roots 13.

As regards the rolling die 1 for roll-forming the workpiece into a spline or a gear, the working teeth 10 are referred to as the "teeth," the crests 11 are referred to as the "tooth crests," the flanks 12 are referred to as the "tooth surfaces," and the roots 13 are referred to as the "tooth bottoms." Further, the present invention may be applied to a rolling die for roll-forming the workpiece into a thread. In such a case, the working teeth 10 are referred to as the "screw threads," the crests 11 are referred to as the "thread crests," the flanks 12 are referred to as the "flanks," and the roots 13 are referred to as the "roots."

The rolling die 1 has the nitride layer 15, which is formed to a predetermined depth from the molded surface 2. Further, the oxide film 16 is formed on a portion of the nitride layer 15 that is positioned toward the molded surface 2. Furthermore, a shot peening process is performed on the molded surface 2 to increase the compressive residual stress of the molded surface 2.

The nitride layer 15 is a portion obtained by performing a later-described nitriding process on the molded surface 2 and thus diffusing nitrogen in the tool base material of the rolling die 1. When the nitrogen is diffusively intruded into the tool base material, the vicinity (nitride layer 15) of the molded surface 2 hardens without sacrificing the toughness of a portion away from the molded surface 2 (a portion into which no nitrogen intrudes). This not only increases the abrasion resistance of the molded surface 2, but also inhibits the molded surface 2 from chipping.

In a case where the surface hardness (Vickers hardness) of the molded surface 2 is not less than 1100 HV for the whole of the molded surface 2 and the nitride layer 15 is formed to a depth of 20 to 70 μm from the molded surface 2, the abrasion resistance and strength of the molded surface 2 are sufficiently ensured. In a case where the depth of the nitride layer 15 is less than 20 μm, the abrasion resistance of the molded surface 2 cannot be sufficiently obtained. If the depth of the nitride layer 15 exceeds 70 μm, the toughness of the inside of the tool base material in the vicinity of the molded surface 2 decreases to reduce the strength of the molded surface 2.

Further, it is preferable that the surface hardness of the molded surface 2 be not more than 1400 HV. In a case where the tool base material of the rolling die 1 is cold work die steel or high-speed tool steel, particularly, in a case where the tool base material is cold work die steel, it is difficult for the molded surface 2 to have a surface hardness of more than 1400 HV. Therefore, when the surface hardness of the molded surface 2 is not more than 1400 HV, the rolling die 1 is manufactured with ease.

It should be noted that the surface hardness of the molded surface 2 is measured (by using a Vickers hardness tester) in accordance with a test method defined in JIS Z 2244 (ISO 6507-1 and ISO 6507-4). Further, the depth of the nitride layer 15 is measured in accordance with JIS G 0562. More specifically, first of all, the rolling die 1 is cut perpendicularly to the molded surface 2. The resulting cut surface is ground and then corroded, for example, with a nitric acid alcohol solution to color the nitride layer 15. Subsequently, the depth of the nitride layer 15, which is colored to a different color from the internal tool base material, is observed and measured with a microscope.

In the nitriding process, nitrogen is likely to diffusively intrude into the tip so that the nitride layer 15 at the crests 11 are likely to become deeper than the nitride layer 15 at the roots 13. In the present embodiment, the rate of depth change from depth D1 of the nitride layer 15 at the crests 11 to depth D2 of the nitride layer 15 at the roots 13 ((D1−D2)/D1×100) is adjusted to be not higher than 30%. Depth D1 of the nitride layer 15 at the crests 11 is measured at a central position of the crests 11 in the direction in which the working teeth 10 are lined up. Meanwhile, depth D2 of the nitride layer 15 at the roots 13 is measured at a central position of the roots 13 in the direction in which the working teeth 10 are lined up.

Since the rate of depth change from depth D1 to depth D2 is not higher than 30%, depth D2 of the nitride layer 15 at the roots 13 is provided to ensure the abrasion resistance of the roots 13, and the nitride layer 15 at the crests 11 is prevented from being excessively deep. While ensuring the abrasion resistance of the roots 13, This ensures the internal toughness of the working teeth 10 in the vicinity of the crests 11 and inhibits the working teeth 10 in the vicinity of the crests 11 from chipping. As a result, the durability of the molded surface 2 on which the nitride layer 15 is formed by the nitriding process is homogenized to increase the durability of the molded surface 2.

When the molded surface 2 is hardened by the nitride layer 15 with the molded surface 2 having a surface hardness of not less than 1100 HV, the toughness of the molded surface 2 might decrease. In the present embodiment, however, the compressive residual stress is applied to the molded surface 2 by the later-described shot peening process. The applied compressive residual stress is measured by an X-ray stress measurement method based on the use of an X-ray diffractometer.

It is preferable that the compressive residual stress of the molded surface 2 be within the range from −1500 to −1000 MPa. The greater the absolute value of this compressive residual stress, the greater the compressive residual stress of the molded surface 2. Since the compressive residual stress within the above range is applied to the molded surface 2, the toughness of the molded surface 2 is ensured even when the nitride layer 15 is formed in such a manner that the molded surface 2 has a surface hardness of not less than 1100 HV. This inhibits the molded surface 2 from easily chipping due to a decrease in the toughness of the molded surface 2, and thus increases the durability of the molded surface 2.

The oxide film 16 is formed when a later-described alkaline blackening process is performed to oxidize the vicinity of the molded surface 2 of the tool base material. The oxide film 16 is a black film mainly made of $Fe_3O_4$ (triiron tetraoxide) that is obtained by oxidizing iron in the tool base material. It should be noted that iron oxide of the oxide film 16 includes only $Fe_3O_4$ and does not include $Fe_2O_3$ (ferric oxide). The oxide film 16 is formed on a portion such that depth D3 from the molded surface 2 is 0.5 to 5 μm. Depth D3 of the oxide film 16 is measured by cutting the rolling die 1 perpendicularly to the molded surface 2, grinding the resulting cut surface, and observing and quantifying the depth of a black portion with a microscope.

Forming the above-described oxide film 16 on the molded surface 2 increases the welding resistance and seizure resistance of the molded surface 2. If depth D3 is less than 0.5 μm, the welding resistance and seizure resistance of the molded surface 2 cannot be sufficiently obtained. If depth D3 is more than 5 μm, the formation of the oxide film 16 merely takes a significant amount of time, and the welding resistance and seizure resistance of the molded surface 2 remain substantially unaffected. When depth D3 of the oxide film 16 is within the range from 0.5 to 5 μm, the welding resistance and seizure resistance of the molded surface 2 are sufficiently obtained, and the time required for the formation of the oxide film 16 is shortened.

A manufacturing method (surface treatment method) for the rolling die 1 will now be described. First of all, an intermediate of the rolling die 1 is prepared. The intermediate is made of the steel tool base material having the molded surface 2 on which the working teeth 10 are formed. The molded surface 2 of the intermediate (tool base material) is nitrided to form the nitride layer 15 (nitriding step). Next, the shot peening process is performed on the nitrided molded surface 2 (shot peening step). Finally, the rolling die 1 is manufactured when the oxide film 16 is formed by performing an oxidation process of oxidizing the molded surface 2 (oxidation step).

The nitriding process is a well-known process of exposing the tool base material (intermediate) to an atmosphere containing nitrogen, heating the tool base material to diffusively intrude the nitrogen into the surface layer of the tool base material, and thus hardening the tool base material. In the present embodiment, it is preferable that a gas nitriding process or a radical nitriding process be used.

The gas nitriding process forms the nitride layer 15 by heating the tool base material in an ammonia gas flow at approximately 500 to 550° C. and allowing nitrogen generated by ammonia decomposition to diffusively intrude into the molded surface 2. The depth of the nitride layer 15 varies with ammonia gas concentration and processing time. In the present embodiment, the gas nitriding process is performed under conditions where the depth of the nitride layer 15 is to be 20 to 70 μm.

If the ammonia gas concentration is high, a porous, brittle nitrogen compound layer is likely to form on the surface of the nitride layer 15, and thus decreases the durability of the molded surface 2. Further, even if the shot peening process is performed on the molded surface 2 on which the brittle nitrogen compound layer is thickly formed, a part of the nitrogen compound layer is merely removed so that the compressive residual stress applied to the molded surface 2 might be insufficient. Therefore, the conditions for a known gas nitriding process should preferably be set so that the thickness of the nitrogen compound layer is not more than 1.5 μm before the shot peening process and after the gas nitriding process.

The radical nitriding process, for example, heats the tool base material to a temperature of approximately 400 to 550° C. in a vacuum within a reactor, introduces a gas mixture of ammonia and nitrogen into the reactor, and thus generates a plasma on the molded surface 2. An NH radical generated by the plasma causes the nitrogen to diffusively intrude into the molded surface 2, and thus forms the nitride layer 15. As is the case with the gas nitriding process, the radical nitriding process is performed under conditions where the depth of the nitride layer 15 is to be 20 to 70 μm. In the radical nitriding process, the nitrogen compound layer is not likely to form; therefore, the nitride layer 15 having a desired thickness is formed within a short period of time. It should be noted that the processing equipment required for the gas nitriding process may be simpler than for the radical nitriding process.

Additionally, an ion nitriding process may also be used for nitriding purposes. The ion nitriding process forms the nitride layer 15 by generating ions through a glow discharge in a mixed gas atmosphere of nitrogen and hydrogen and allowing the generated ions to collide with the molded surface 2. In the ion nitriding process, depth D1 of the nitride layer 15 at the crests 11, with which the ions are prone to collide, is likely to increase, and depth D2 of the nitride layer 15 at the roots 13, with which the ions are prone to collide, is likely to decrease.

Meanwhile, the gas nitriding process and the radical nitriding process are able to decrease the rate of depth change from depth D1 of the nitride layer 15 at the crests 11 to depth D2 of the nitride layer 15 at the roots 13. Particularly, when the rate of depth change is not higher than 30%, that is, when the gas nitriding process or the radical nitriding process is performed under conditions where the rate of depth change is not higher than 30%, the durability of the molded surface 2 is homogenized as described earlier to increase the durability of the molded surface 2.

The shot peening process is a process of projecting a plurality of miniature steel balls or other projection materials onto the molded surface 2 at a predetermined projection pressure. This concaves a portion of the molded surface 2 that the projection materials collide with, and thus imparts the compressive residual stress to the molded surface 2. Processing conditions are to be set so that the compressive residual stress applied to the molded surface 2 immediately after the shot peening process is approximately −1550 to −1050 MPa.

The oxidation process is an alkaline blackening process in which the tool base material already subjected to the nitriding process and the shot peening process is immersed in an alkaline aqueous solution having a temperature of 130 to 160° C. for oxidizing the tool base material. Due to this oxidation process, the oxide film 16 mainly made of $Fe_3O_4$ and obtained by oxidizing iron in the tool base material is formed on the molded surface 2. Processing conditions for the alkaline blackening process are to be set so that depth D3 of the oxide film 16 is 0.5 to 5 μm.

The alkaline aqueous solution used for the alkaline blackening process is well known and, for example, a solution obtained by mixing a high-concentration caustic soda solution with a small amount of oxidant. As the oxidant to be added, for example, sodium nitrite, sodium cyanide, sodium phosphate, lead oxide, or sodium thiosulfate is used.

As the oxidation process, a steam oxidation process may be performed as an alternative to the alkaline blackening process. The steam oxidation process forms the oxide film 16 by heating the tool base material in a steam atmosphere having a temperature of approximately 500° C. However, in the steam oxidation process in which the molded surface 2 is heated to a high temperature, the compressive residual stress is likely to be released by the shot peening process. Meanwhile, in the alkaline blackening process in which the molded surface 2 is merely heated to a temperature of approximately 130 to 160° C., the compressive residual stress is not likely to be released by the shot peening process. This not only allows the oxide film 16 to increase the welding resistance and seizure resistance of the molded surface 2, but also imparts the compressive residual stress to ensure the toughness of the molded surface 2. Consequently, the durability of the molded surface 2 is further increased.

It should be noted that the shot peening process and the oxidation process are performed under conditions where the compressive residual stress applied to the molded surface 2 after the oxidation process is −1500 to −1000 MPa. In a case where the alkaline blackening process of heating the molded surface 2 to a temperature of approximately 130 to 160° C. is performed for a time period shorter than 30 minutes to form the oxide film 16 having a depth of not more than 5 μm, the compressive residual stress released by the alkaline blackening process is not higher than approximately 50 MPa. When the processing conditions for the shot peening process are set so that the compressive residual stress applied to the molded surface 2 immediately after the shot peening process is approximately −1550 to −1050 MPa, the compressive residual stress applied to the molded surface 2 after the oxidation process is −1500 to −1000 MPa.

In a case where the nitriding process is performed after the shot peening process, the compressive residual stress is released due to heating during the nitriding process. Further, in a case where the shot peening process is performed after the oxidation process, the oxide film 16 is occasionally removed due to the collision of the projection materials. Therefore, the tool base material needs to be sequentially subjected to the nitriding process, the shot peening process, and the oxidation process in the order named.

Further, the manufacturing method applied to the rolling die 1 is determined by confirming the rolling die 1 after each process without having to confirm an adopted manufacturing method. First of all, when the nitride layer 15 has a depth of 20 to 70 μm while the surface hardness of the molded surface 2 is not less than 1100 HV, and the rate of depth change from depth D1 of the nitride layer 15 at the crests 11 to depth D2 of the nitride layer 15 at the roots 13 is not higher than 30%, it is revealed that the rolling die 1 is manufactured by performing the gas nitriding process or the radical nitriding process on the molded surface 2 of the tool base material.

Particularly, when the surface hardness of the molded surface 2 is not less than 1100 HV while the rolling die 1 is made of a tool base material formed, for example, of alloy tool steel or high-speed tool steel, it is revealed that the rolling die 1 is manufactured by performing the nitriding process without having to cut the rolling die 1 and confirm the nitride layer 15. The reason is that, when the tool base material is formed of alloy tool steel or high-speed tool steel, the surface hardness of the molded surface 2 is not equal to or more than 1100 HV in a state where the nitriding process is not performed.

When the compressive residual stress of the molded surface 2 is −1500 to −1000 MPa while the rolling die 1 made of the tool base material formed of alloy tool steel or high-speed tool steel has the above-described nitride layer 15, it is revealed that the rolling die 1 is manufactured by performing the shot peening process after the gas nitriding process or the radical nitriding process. One reason is that the compressive residual stress applied by the shot peening process is not released by heating during the nitriding process. Another reason is that, in a case where the tool base material is formed of alloy tool steel or high-speed tool steel and only the nitriding process is performed without performing the shot peening process, the compressive residual stress of the molded surface 2 is not within the range from −1500 to −1000 MPa.

Further, when the compressive residual stress of the molded surface 2 of the molding die 1 made of the tool base material formed of alloy tool steel or high-speed tool steel is −1500 to −1000 MPa while the oxide film 16 having depth D3 of 0.5 to 5 μm is formed, it is revealed that the rolling die 1 is manufactured by performing the alkaline blackening process after the shot peening process. The reason is that the compressive residual stress applied by the shot peening process is barely released by heating during the oxidation process (alkaline blackening process).

Further, in a case where the oxide film 16 is formed by the steam oxidation process, the iron oxide iron oxide of the oxide film 16 includes both $Fe_3O_4$ and $Fe_2O_3$. Meanwhile, in a case where the oxide film 16 is formed by the alkaline blackening process, the iron oxide of the oxide film 16 includes only $Fe_3O_4$. Consequently, in a case where the components of the oxide film 16 are XRD-measured with an X-ray diffractometer and the result of the measurement indicates that the oxide film 16 is formed of $Fe_3O_4$ only, it is revealed that the oxide film 16 is formed by the alkaline blackening process. As described earlier, when the alkaline blackening process is performed, the compressive residual stress imparted in advance to the molded surface 2 is more unlikely to be released at the time of formation of the oxide film 16 than when the steam oxidation process is performed. When the oxide film 16 is formed by the alkaline blackening process, the compressive residual stress to be imparted in advance to the molded surface 2 is reduced in order to maintain the compressive residual stress of the molded surface 2 covered with the oxide film 16 within the range from −1500 to −1000 MPa. As a result, the rolling die 1 is manufactured with ease.

An endurance test conducted by using the above-described rolling die will now be described. The endurance test is conducted to measure the total number of successively machinable screws (hereinafter referred to as the "life durability count") in a case where rolling is performed to surface-treat the molded surface 2 of the rolling die by using a pair of each of four different samples (samples 1 to 4). More specifically, the life durability count indicates the number of screws that has been reached before an unacceptable screw is encountered each time 1000 roll-formed screws are inspected with a thread gauge. Further, rolling is performed by moving one of each sample pair with the other one fixed.

Each of the samples used in the endurance test is a rolling flat die that has a moving side length (FIG. 1(*a*) left-right dimension) of 140 mm, a fixed side length of 125 mm, a thickness (FIG. 1(*b*) up-down dimension) of 40 mm, a height (width, FIG. 1(*a*) up-down direction) of 32 mm, a nominal dimension of M8×1.25, and a steel grade of SKD 11. Further, the workpiece to be subjected to roll forming is stainless steel having a Rockwell hardness of HRC 2C. In the endurance test, 60 workpieces are machined in one minute.

Samples 1 are obtained by sequentially performing the gas nitriding process, the shot peening process, and the alkaline blackening process on the molded surface 2. Samples 2 are obtained by sequentially performing the ion nitriding process, the shot peening process, and the steam oxidation process on the molded surface 2. Samples 3 are obtained by sequentially performing the gas nitriding process and the shot peening process on the molded surface 2. Samples 4 are obtained by sequentially performing the ion nitriding process and the shot peening process on the molded surface 2.

The ion nitriding process for samples 2 and 4 is performed under conditions where the mixing ratio (volume ratio) between nitrogen gas and hydrogen gas is approximately 3:7, the heating temperature is 500° C., and the heating time is 3 hours. These conditions are set so that the molded surface 2 has a surface hardness of approximately 1200 HV after the ion nitriding process. The gas nitriding process for samples 1 and 3 is performed under conditions where the molded surface 2 has a surface hardness of approximately 1200 HV after the gas nitriding process, and the thickness of the nitrogen compound layer after the gas nitriding process is equivalent to the thickness of the nitrogen compound layer of samples 2 and 4 after the gas nitriding process.

The shot peening process for each pair of samples is performed by concentrically placing each pair of samples on a rotary table, rotating the rotary table at a speed of 2500 mm/minute, and spraying projection materials from three nozzles that are disposed at equal angular intervals around each pair of samples and at a distance of 150 mm from the molded surface 2. Each of the three nozzles sprays steel projection materials having a grain size of #300 by using compressed air at 0.5 MPa.

In the alkaline blackening process, samples 1 are initially degreased, washed with water, and washed for 20 to 30 seconds in an acid pickling tank containing 15% hydrochloric acid at pH (hydrogen-ion exponent) 2 to 3. Subsequently, samples 1 are washed with water and then immersed in an alkaline aqueous solution at 138±3° C. for 20 to 25 minutes. Afterwards, samples 1 are washed with water, and placed in a water replacement anti-rust oil tank for rust prevention purposes. Components of the alkaline aqueous solution are set so that depth D3 of the oxide film 16 of samples 1 is approximately 2.0 μm under the above-mentioned heating conditions. The steam oxidation process for samples 2 is performed in such a manner that depth D3 of the oxide film 16 of samples 2 is approximately 1.0 μm.

Table 1 illustrates the surface treatment, compressive residual stress (MPa) of molded surface 2, and surface hardness (HV 0.3 (Vickers hardness at a test force of 2.942 N)) of molded surface 2 of each sample. Table 2 illustrates depth D1 (μm) of nitride layer 15 at crests 11, depth D2 (μm) of nitride layer 15 at roots 13, depth D3 (μm) of oxide film at crests 11, and life durability count of each sample.

TABLE 1

| Samples | Surface treatment | Compressive residual stress (MPa) | Surface hardness (HV0.3) |
|---|---|---|---|
| 1 | Gas nitriding process →Shot peening process →Alkaline blackening process | approx. −1150 | approx. 1200 |
| 2 | Ion nitriding process →Shot peening process →Steam oxidation process | approx. −500 | approx. 1200 |
| 3 | Gas nitriding process →Shot peening process | approx. −1200 | approx. 1200 |
| 4 | Ion nitriding process →Shot peening process | approx. −1200 | approx. 1200 |

TABLE 2

| Samples | Depth of nitride layer at crests (μm) | Depth of nitride layer at roots (μm) | Depth of oxide film (μm) | Life durability count |
|---|---|---|---|---|
| 1 | 40 | 35 | 2.0 | 180000 |
| 2 | 50 | 25 | 1.0 | 81000 |
| 3 | 40 | 35 | | 103000 |
| 4 | 50 | 25 | | 101000 |

As illustrated in Tables 1 and 2, samples 1 and 3, which are gas-nitrided, are such that the difference in the depth of the nitride layer 15 between the crests 11 and the roots 13 is as small as approximately 5 μm. Meanwhile, samples 2 and 4, which are ion-nitrided, are such that the difference in the depth of the nitride layer 15 between the crests 11 and the roots 13 is as great as approximately 25 μm. The life durability count of samples 3 is 103000 and higher than the life durability count of samples 4, which is 101000. Therefore, a comparison between samples 3 and 4 reveals that the life durability count of the rolling die is relatively high when the difference in the depth of the nitride layer 15 between the crests 11 and the roots 13 is relatively small. Consequently, it is revealed that the durability of the molded surface 2 of the rolling die increases when the nitride layer 15 is formed by the gas nitriding process.

A comparison between samples 2 and 4 indicates that the compressive residual stress of the molded surface 2 is reduced to half or lower, that is, from approximately −1200 to approximately −500, when the steam oxidation process is performed after the shot peening process. Further, the comparison reveals that the life durability count of samples 2 is 81000 while the life durability count of samples 4 is 101000. This signifies that the life durability count is lowered by the steam oxidation process.

A comparison between samples 1 and 3 indicates that, even when the alkaline blackening process is performed after the shot peening process, the compressive residual stress of the molded surface 2 merely changes from approximately −1200 to approximately −1150, that is, remains barely unaffected. Further, the life durability count of samples 1 is 180000 while the life durability count of samples 3 is 103000. This signifies that the life durability count is increased by the formation of the oxide film 16. Therefore, it is revealed that the durability of the molded surface 2 of the rolling die increases when the oxide film 16 is formed by performing the alkaline blackening process after the shot peening process.

Next, samples 5 and 6 are prepared by changing samples 1 and 2 to a nominal dimension of No. 4-40 UNC (unified coarse thread). Table 3 illustrates depth D1 of nitride layer 15 at crests 11, depth D2 of nitride layer 15 of roots 13, and rate of depth change from depth D1 to depth D2 ((D1−D2)/D1×100) (%) of samples 1, 2, 5, and 6. Although detailed values are not depicted, it is confirmed that the life durability count of samples 5 is higher than the life durability count of samples 6.

TABLE 3

| | Gas nitriding process →Shot peening process →Alkaline blackening process | | Ion nitriding process →Shot peening process →Steam oxidation process | |
|---|---|---|---|---|
| | Samples 1 M8 × 1.25 | Samples 5 No. 4-40UNC | Samples 2 M8 × 1.25 | Samples 6 No. 4-40UNC |
| Crest | 40 μm | 30 μm | 50 μm | 22 μm |
| Root | 35 μm | 23 μm | 25 μm | 11 μm |
| Rate of change | 12.5% | 23.3% | 50.0% | 50.0% |

As illustrated in Table 3, samples 2 and 6, which are obtained by performing the ion nitriding process on the molded surface 2, are such that the rate of depth change from depth D1 to depth D2 is approximately 50%. This reveals that, in a case where the ion nitriding process is performed on the molded surface 2, depth D1 of the nitride layer 15 at the crests 11 is significantly different from depth D2 of the nitride layer 15 at the roots 13 without regard to the size of the working teeth 10 (the size of a roll-formed screw).

Meanwhile, in a case where the gas nitriding process is performed on the molded surface 2, the rate of depth change from depth D1 to depth D2 is 12.5% in samples 1 and 23.3% in samples 5. That is to say, in the case where the gas nitriding process is performed on the molded surface 2, it is revealed that the rate of depth change increases with a decrease in the size of the working teeth 10. Even when the sizes of the working teeth 10 for other standardized screws are taken into consideration, it is estimated that the rate of depth change from depth D1 to depth D2 is not higher than 30% in the case where the gas nitriding process is performed on the molded surface 2. Consequently, as the life durability counts of samples 1 and 5 whose depth change rates are not higher than 30% are higher than the life durability counts of samples 2 and 6 whose depth change rates are higher than 30%, it is revealed that the durability of the molded surface 2 of the rolling die increases when the depth change rate is not higher than 30%.

Although the present invention has been described with reference to the foregoing embodiment, the present invention is not limited to the foregoing embodiment. It will be easily understood by persons skilled in the art that various improvements and modifications can be made without departing from the spirit and scope of the present invention. For example, the shape and dimensions of the working teeth 10 may be changed as appropriate.

Further, the processing conditions for the nitriding process, shot peening process, and oxidation process according to the forgoing embodiment are suitable for a case where the tool base material of the rolling die 1 is alloy tool steel, high-speed tool steel, or particularly cold work die steel. The individual processing conditions may be changed as appropriate based, for example, on the type of the tool base material in order to obtain desired characteristics described in conjunction with the foregoing embodiment.

The foregoing embodiment has been described on the assumption that the rolling die 1 is a rolling flat die. However, the rolling die 1 is not limited to the rolling flat die. The present invention may be applied to a rolling cylindrical die. Further, the present invention may be also applied to a fan-shaped segment die. Moreover, the present invention may be applied not only to the rolling die 1, which roll-forms the outer circumferential surface of a workpiece into a spline or a gear on, but also to a rolling die that roll-forms the outer circumferential surface of the workpiece into a thread. That is to say, the lead angle of the working teeth 10 may be changed from 90°.

The foregoing embodiment has been described on the assumption that the rolling die 1 has the predetermined nitride layer 15 and oxide film 16, and that the compressive residual stress of the molded surface 2 is −1500 to −1000 MPa. However, the rolling die 1 is not limited to such a configuration. The molded surface 2 need not necessarily be subjected to the oxidation process of forming the oxide film 16 having depth D3 of 0.5 to 5 μm. Further, the molded surface 2 need not necessarily be subjected to the shot peening process of applying a compressive residual stress of −1500 to −1000 MPa to the molded surface 2. The above-described alternative configuration not only simplifies the manufacturing steps for the rolling die 1, but also reduces the manufacturing cost of the rolling die 1.

DESCRIPTION OF REFERENCE NUMERALS

1: rolling die
2: molded surface
10: working teeth
11: crest
13: root
15: nitride layer
16: oxide film

The invention claimed is:

1. A rolling die comprising:

a tool base material that is made of steel and has a molded surface on which a plurality of working teeth is formed;

wherein the tool base material includes a nitride layer in which nitrogen is diffused, the nitride layer being disposed to reach a position that is 20 to 70 μm in depth from the molded surface;

wherein the molded surface has a surface hardness of at least 1100 HV;

wherein the rate of depth change of the nitride layer from crests of the working teeth to roots of the working teeth is not higher than 30%;

wherein the compressive residual stress of the molded surface is −1500 to −1000 MPa; and wherein an oxide film is formed on a portion of the nitride layer that is positioned 0.5 to 5 μm deep from the molded surface, the oxide film being mainly made of $Fe_3O_4$ that is obtained by oxidizing the tool base material.

2. The rolling die according to claim 1, wherein iron oxide of the oxide film includes only $Fe_3O_4$.

3. A rolling die manufacturing method for manufacturing a rolling die including a tool base material that is made of steel and has a molded surface on which a plurality of working teeth is formed, the rolling die manufacturing method comprising:

a nitriding step of forming a nitride layer by performing a gas nitriding process or a radical nitriding process on the molded surface in such a manner that the surface hardness of the molded surface is at least 1100 HV and that the depth of the nitride layer from the molded surface is 20 to 70 μm; and a shot peening step of imparting compressive residual stress to the molded surface by performing a shot peening process on the molded surface that has been nitrided in the nitriding step; and an oxidation step of forming an oxide film on the molded surface by performing an alkaline blackening process after the shot peening step, the oxide film being mainly made of $Fe_3O_4$, the alkaline blackening process oxidizing the tool base material by immersing the tool base material in an alkaline aqueous solution at a temperature of 130 to 160° C.

4. The rolling die manufacturing method according to claim 3, wherein the shot peening and the oxidation step are performed under conditions where the compressive residual stress of the molded surface is −1500 to −1000 MPa after the oxidation step.

* * * * *